US005381747A

United States Patent [19]

Hinde

[11] Patent Number: 5,381,747

[45] Date of Patent: Jan. 17, 1995

[54] MAST BOX FOR A SAILBOARD

[75] Inventor: Brian Hinde, Hood River, Oreg.

[73] Assignees: Michael G. Stavros, San Pedro; Larry W. Allison, Lakewood, both of Calif.

[21] Appl. No.: 38,366

[22] Filed: Mar. 29, 1993

[51] Int. Cl.[6] ..... B63B 35/79

[52] U.S. Cl. ..... 114/39.2; 441/74; 441/79

[58] Field of Search ..... 114/39.2, 91, 93, 89, 114/204; 441/74, 75, 79, 65

[56] References Cited

U.S. PATENT DOCUMENTS

| | | | |
|---|---|---|---|
| 1,323,732 | 12/1919 | Allen | 441/74 |
| 1,872,230 | 8/1932 | Blake | 441/74 |
| 4,718,367 | 1/1988 | Camp et al. | 114/93 |
| 4,964,825 | 10/1990 | Paccoret et al. | 441/74 |

FOREIGN PATENT DOCUMENTS

| | | | |
|---|---|---|---|
| 2555118 | 5/1985 | France | 114/91 |
| 2829380 | 1/1980 | Germany | 441/74 |
| 3030078 | 3/1982 | Germany | 441/74 |

*Primary Examiner*—Edwin L. Swinehart
*Attorney, Agent, or Firm*—Jordan and Hamburg

[57] ABSTRACT

A mast box for a sailboard is embedded in the sailboard. The mast box has a T-shaped groove for clamping a mast foot to the sailboard, a pin for holding a leash rope, and a vent for venting pressure from the core of the sailboard. The vent may include a one way valve.

24 Claims, 4 Drawing Sheets

MAST BOX FOR A SAILBOARD

This invention is concerned with sailboards, otherwise known as "windsurfboards", and is more in particular directed to the provision of a sailboard having an improved mast box, as well as to the mast box itself.

BACKGROUND OF THE INVENTION

Sailboards of one type are comprised of a thin elongated hull having a core of floatable material, such as styrofoam. A fitting is provided on the hull in order to support a mast.

U.S. Pat. No. 4,276,844, Fremont, discloses a sail board hull of foam polyurethane with fiberglass cover. The hull has box with a flange sealed to the shell of the board, for receiving a mast. The mast box of this reference is open only at its top.

U.S. Pat. No. 4,579,074, Camp et al, discloses a sailboard in which a mast box is embedded in the hull of the sailboard. The mast box has an inverted T shaped groove, the groove having an upper surface flush with the board. The T shaped groove receives a shoulder bolt adapted to support the mast. The shoulder bolt can be either attached directly to the mast, or indirectly connected to the mast via a rubber power joint of hour glass shape.

U.S. Pat. No. 4,730,568, Campbell, discloses a sailboard having an insert removably mounted to its upper surface, for conversion of the sailboard between a sailboard mode and paddle-ski mode. In the sailboard mode, the insert exposes a recessed rail for receiving a mast base.

In the mounting of a sail to a sailboard, it is desirable, and in some cases mandatory, to provide means for tethering the mast to the sailboard, in order to ensure that the rigging does not float away from the board in the event, for example, that the sailboard is upset in use. A cord or leash line for serving this function is depicted in the 1992 "Sailboard Buyer's Guide and Catalog", Sailboard Warehouse, Inc, Saint Paul, Minn. for example at page 60, wherein the cord is affixed to the mast foot or base and adapted to be connected to the mast via a pin through the latter.

Other mast mounting arrangements are disclosed, for example, in U.S. Pat. No. 4,526,120, U.S. Pat. No. 4,527,499, U.S. Pat. No. 4,558,655, U.S. Pat. No. 4,653,416, U.S. Pat. No. 4,679,516, and U.S. Pat. No. 4,735,163.

SUMMARY OF THE INVENTION

It is an object of the present invention to provide a sailboard having a mast box permanently mounted in the hull of the sailboard, and including means for adjustably mounting the mast or a mast foot or base therein, as well as means for receiving a leash for preventing the mast from floating away from the sailboard.

In use, a sailboard is frequently transported or stored under very heated conditions. For example, the sailboard may be carried on the top of a car, and exposed to hot sunlight. If the core of the sailboard is made of an open cell foam, such as an extruded cell styrofoam, such heating of the board will effect the expansion of air held by the foam. Such expansion of the air within the core may cause a build-up of pressure within the hull that may result in damage to the hull. Accordingly, it is another object of the invention to provide a sailboard employing a core of extruded polystyrene foam or the like, wherein means are provided for releasing pressure within the sailboard.

Briefly stated, in accordance with the invention, a mast box for a sailboard has an elongated cavity for receiving a clamping means of a mast foot. The cavity enables the adjustment of the longitudinal position of the mast foot on the sailboard. The cavity may have a T-shaped cross section.

A pin extends transversely within the cavity, to receive a leash rope affixed to the mast foot. This feature of the invention enables the prevention of the rigging from floating away from the sailboard, in a simple and economical manner.

The mast box is embedded within the sailboard, having an upper surface substantially flush with the top of the sailboard. A vent hole is provided in the mast box, for venting pressure from the core of the sailboard. The vent hole is closed during the manufacture of the sailboard and embedding of the mast box therein, in order to prevent escape of the foam of the core through the vent hole.

The vent hole may be selectively sealed, during use, by a seal plug. Alternatively, a valve may be provided in the vent hole to permit the release of pressure from the core, while preventing the entry of water to the interior of the sailboard.

BRIEF DESCRIPTION OF THE DRAWING

In order that the invention may be more clearly understood, it will now be disclosed in greater detail with reference to the accompanying drawing, wherein.

DETAILED DISCLOSURE OF THE INVENTION

Figure 1:
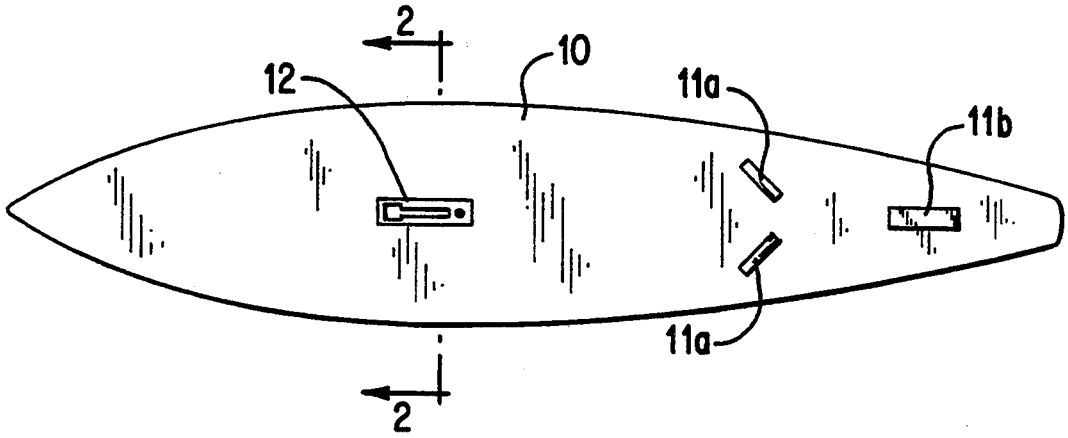
FIG. 1 is a top view of a sailboard in accordance with the invention.
Figure 2:
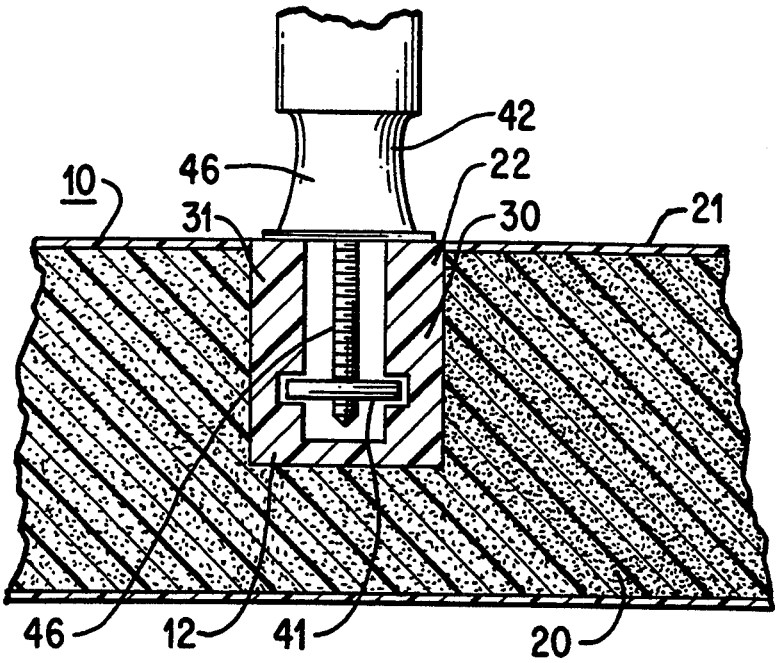
FIG. 2 is an enlarged cross sectional view of a portion of the sailboard of FIG. 1, taken along the lines 2—2, and including a portion of a power joint for supporting a mast.

Referring now to the drawings, and more in particular to FIG. 1, therein is illustrated the top view of a sailboard in accordance with the invention, having a hull 10. Conventional foot straps **11*a* and a back strap 11*b* are mounted to the hull, and a mast box 12 is embedded in the hull. As seen in FIG. 2, the hull 10 may be comprised of a core 20, for example of an open cell foam such as extruded polystyrofoam (EPS). The hull is provided with a skin 21, for example of an epoxy composite. A mast box 12** is embedded in the hull. The mast box is preferably embedded in the hull during the fabrication of the hull, and may be comprised of a plastic.

As illustrated in FIGS. 3–8, the mast box 12 in accordance with one embodiment of the invention comprises an elongated molded box having opposed side walls 30, 31, a bottom 32, and end walls 33, 34. These walls define a central upwardly open groove or slot 35. The outer side walls of the mast box 12 may be provided with ribs 38 or the like, in order to more firmly hold the mast box in the hull of the sailboard.

Figure 3:
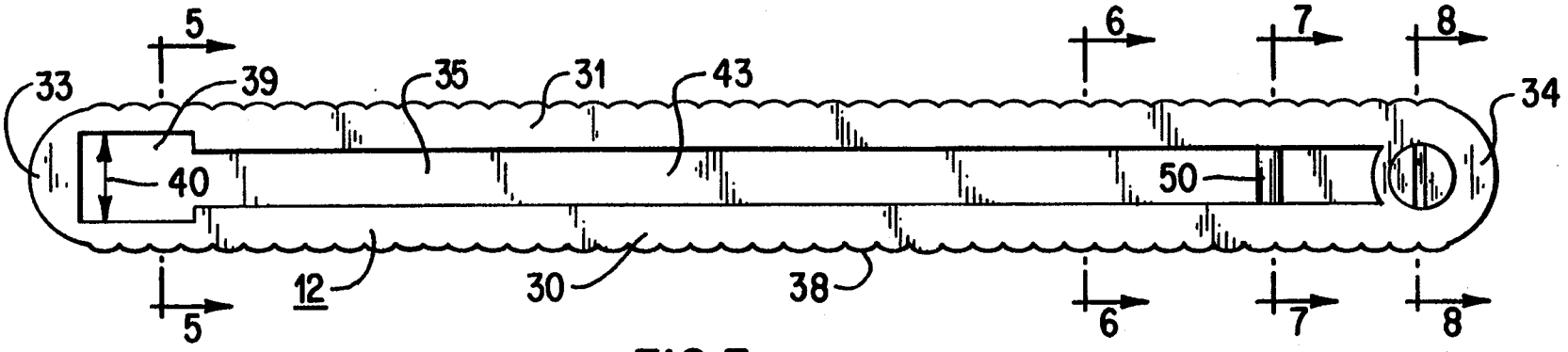
FIG. 3 is a top view of one embodiment of a mast box in accordance with the invention.
Figure 4:
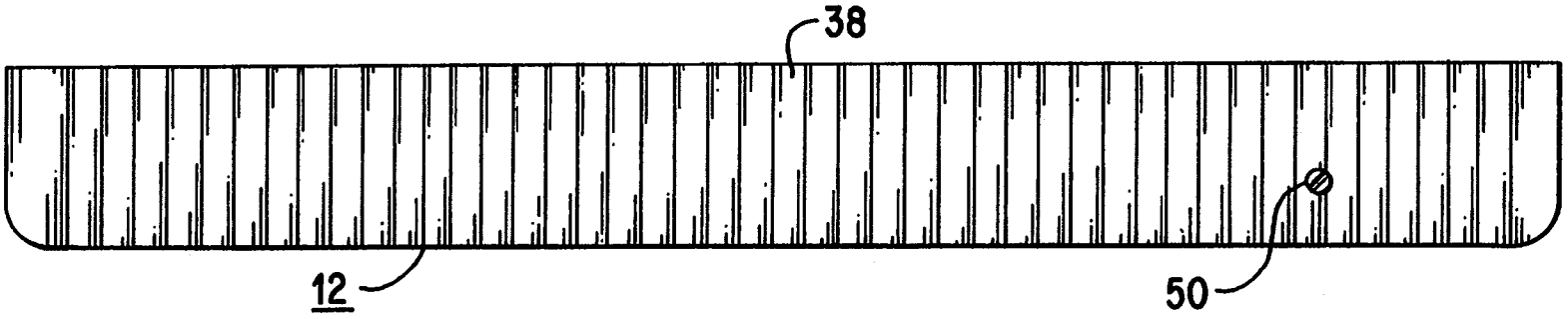
FIG. 4 is a side view of the mast box of FIG. 3.
Figure 5:
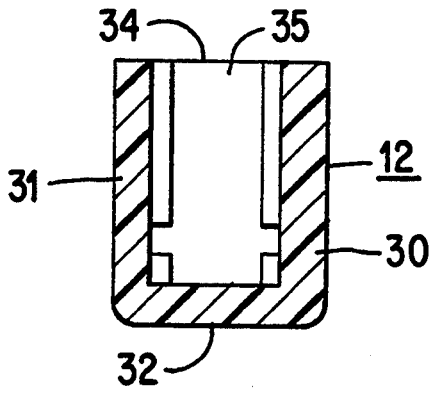
FIG. 5 is a cross sectional view of the mast box of FIG. 3 taken along the lines 5—5.
Figure 6:
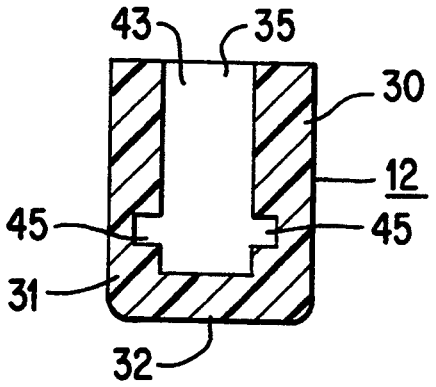
FIG. 6 is a cross sectional view of the mast box of FIG. 3 taken along the lines 6—6.
Figure 7:
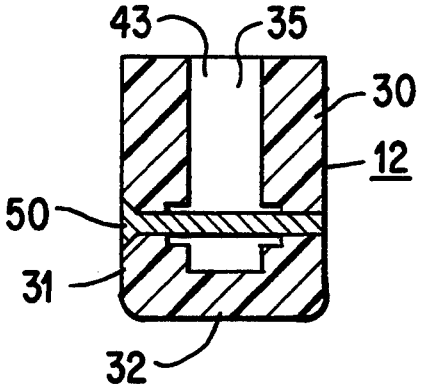
FIG. 7 is a cross sectional view of the mast box of FIG. 3 taken along the lines 7—7.

As illustrated in FIGS. 3 and 5, the portion 39 of the slot 35 adjacent the end wall 33 may be generally rectangular in cross section, with a width 40 sufficient to receive a track nut 41 for a mast foot 42, as seen in FIG. 2. The spacing between the sidewalls 30, 31 in the portion 43 of the slot 35 extending from the portion 39 to the end wall 34 is less than that in the portion 39, and aligned longitudinally extending retaining track slots 45 are provided in these walls, preferably adjacent the bottom of the slot 35. The spacing between the bottoms of these track slots 45 may be equal to the width 40 between the mast box walls in the portion 39 of the mast box.

As illustrated in FIG. 2, the slots 45 receive the track nut 41, threaded on a retaining bolt 46 extending into the groove 35 from the mast foot 42. The mast foot 42 may be comprised of a conventional hour-glass shaped power joint 46. The groove 35, in combination with the slots 45, thus form a T-shaped slot for clamping the mast to the sail board. In assembly, the nut 41 is initially loosely threaded on the bolt 46. The nut is then fed into the portion 39 of the mast box, until the nut is aligned with the slots 45. The nut, along with the mast foot, is then slid along the sailboard until the desired position is reached. The mast foot may then be rotated to tighten the nut, since the outer periphery of the nut is restrained from rotation by the walls of the mast box.

Figure 9:
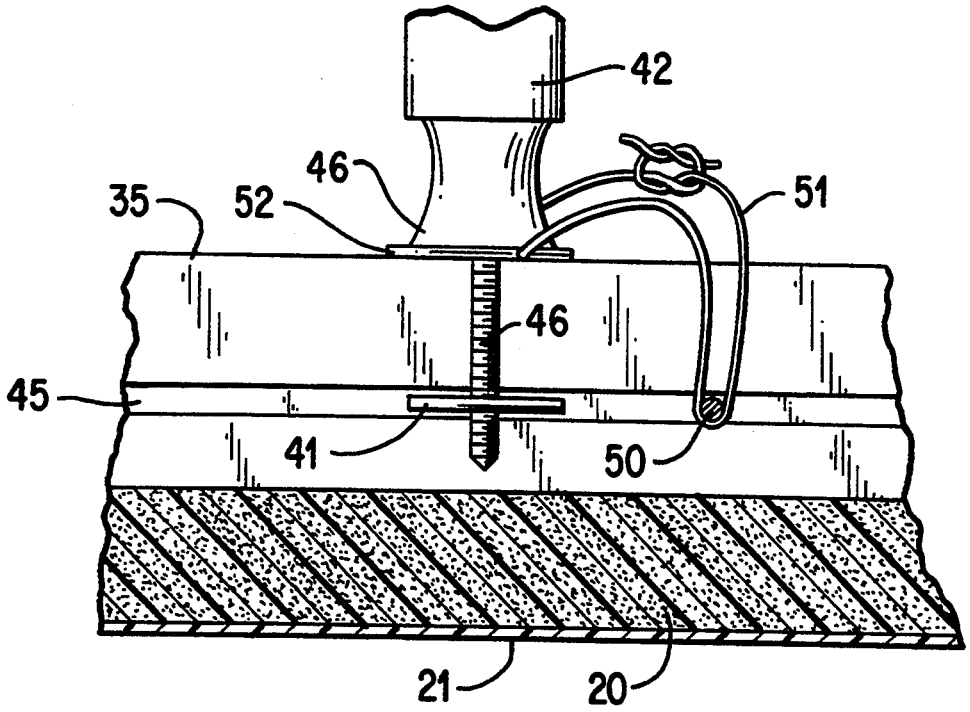
FIG. 9 is an enlarged longitudinal section of a portion of the mast box of FIG. 1, including a portion of the power joint for supporting the mast.

In accordance with the invention, a pin 50 is provided extending between the side walls 30, 31, and through the T-shaped retaining groove, adjacent the end wall 34 of the mast box. As seen in FIG. 9, the pin 50 may be employed to prevent the mast from floating away from the sailboard. Thus, a leash rope 51 may be fed through the slot 35 to surround the pin 50, the leash rope 51 extending through a suitable hole in the base plate 52 of the mast foot or the like, to form a closed loop. This arrangement provides a simple and inexpensive solution to the problem of holding the mast to the sailboard. The pin 50 may be a metal pin.

Figure 8:
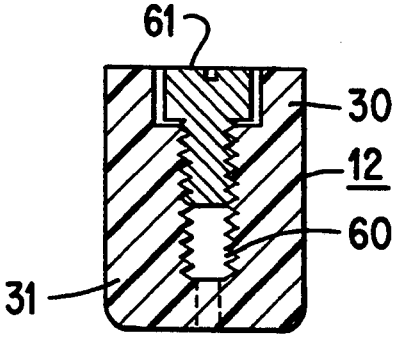
FIG. 8 is a cross sectional view of the mast box of FIG. 3 taken along the lines 8—8.

Referring now to FIGS. 3 and 8, in accordance with a further feature of the invention, a centrally threaded hole 60 is provided extending into the top of the end wall 34 of the mast box. During the manufacture of the sailboard, the bottom of the hole 60 is blind. Accordingly, the material of the core cannot escape via the hole 60. Subsequent to the manufacture of the sailboard, however, and prior to its use, the bottom of the hole 60 is drilled out, as shown in dashed lines in FIG. 8, to provide an escape vent for pressure that may have built up in the core, for example due to exposure of the sailboard to heat and sunlight. When the sailboard is to be used, the hole 60 may be sealed by a plug 61 sealingly threaded into the hole 60, to prevent exposure of the core to water. This plug is of course preferably loosened when the board is not in use.

Figure 10:
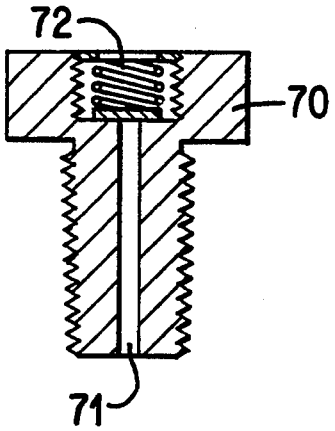
FIG. 10 is a cross sectional view of an alternative sealing plug for the vent hole of the mast box.

In accordance with the invention, other arrangements may alternatively be provided for venting the core of the sailboard. For example, as illustrated in FIG. 10, the seal plug 61 for sealing the vent hole 60 may be replaced by a vented seal plug 70. This plug may be comprised, for example only, of a threaded bolt having a central hole 71 extending axially therethrough. The upper end of the hole 71 is enlarged and threaded to receive a one way valve 72, the upper end of the narrower portion of the hole 71 serving as a valve seat. The seal plug 70 of FIG. 10 thus serves to relieve pressure within the core of the sailboard whenever the pressure is greater than ambient pressure. Accordingly, it is not necessary for the user to loosen the seal plug when the sailboard is not in use.

Figure 11:
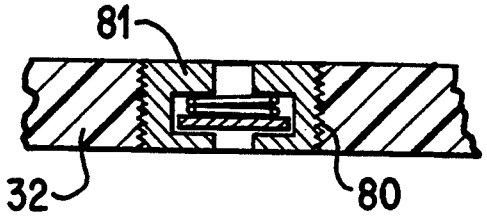
FIG. 11 is a cross section of a portion of the bottom of the mast box illustrating a further modification thereof.

In a further embodiment, as illustrated in FIG. 11, the mast box is not provided with the vent hole 60 at the end of the slot 35. In this case, a threaded hole 80 is provided in the bottom wall 32, and a one way valve 81 is threaded into the hole 80. The one way valve may be formed in a manner similar to the one way valve of FIG. 10. In the use of this arrangement, the bottom of the mast box 12 may be initially provided without any hole therein, the hole 80 being formed and threaded after the mast box has been embedded in the sailboard. The one way valve 81 may be thus threaded into the hole 80 as one of the last steps in the manufacture of the sailboard.

While the invention has been disclosed and described with reference to a limited number of embodiments, it will be apparent that variations and modifications may be made therein, and it is therefore intended in the following claims to cover each such variation and modification as falls within the true spirit and scope of the invention.

What is claimed is:

1. A mast box for a sailboard, comprising means for adjustably clamping a mast foot thereto, means for receiving a leash rope and means for venting pressure in the sailboard, said venting means being in a portion of said mast box accessible to a user.

2. The mast box of claim 1 wherein said means for clamping a mast foot thereto comprises a T shaped groove, and said means for receiving a leash rope is a pin mounted to extend transversely across said groove.

3. The mast box of claim 1 wherein said venting means comprises a hole in said mast box, and sealing means for releasably sealing said hole.

4. The mast box of claim 1 wherein said venting means comprises a one way valve.

5. The mast box of claim 1 wherein said sailboard has a face; said mast box has a top portion exposed on a face of said sailboard; and the portion of said mast box including said venting means is said top portion.

6. In a sailboard having a core of open cell foam, the improvement comprising a mast box embedded in said sailboard and having an upper surface substantially flush with the upper surface of said sailboard, said mast box having means for clamping a mast foot to said sailboard, means for venting pressure in the core of the sailboard, said venting means being in a portion of said mast box accessible to a user, and means for holding a leash rope for said mast foot.

7. The sailboard of claim 6 wherein said means for clamping a mast foot to said sailboard comprises a T shaped open top groove extending longitudinally of said mast box, and said means for holding a leash rope for said mast foot comprises a pin extending transversely of said groove, whereby a leash rope may extend in said groove around said pin.

8. The sailboard of claim 6 wherein said venting means comprises a hole in said mast box.

9. The sailboard of claim 8 wherein said venting means further comprises means for selectively sealing said hole.

10. The sailboard of claim 8 wherein said venting means comprises a one way valve.

11. The mast box of claim 6 wherein said sailboard has a face; said mast box has a top portion exposed on a face of said sailboard; and the portion of said mast box including said venting means is said top portion.

12. A sailboard comprising a hull having an upper surface, said sailboard having an elongated body portion of rigid foam material and a mast box fixedly embedded in said body portion, said mast box having an elongated cavity with a substantially closed bottom wall within said body portion of said hull, and an open top substantially flush with said upper surface of said hull, said cavity further having at least one side wall with a longitudinally extending groove for receiving a nut of a mast foot, means for venting pressure in the sailboard, said venting means being in a portion of said mast box accessible to a user, and further comprising a pin for holding a leash rope and extending transversely through said cavity and supported by the sidewalls thereof, said pin being spaced from said bottom wall and the open top of said mast box.

13. The sailboard of claim 12 wherein said cavity has a T shaped cross section.

14. The sailboard of claim 12 wherein said sailboard has a face; said mast box has a top portion exposed on a face of said sailboard; and the portion of said mast box including said venting means is said top portion.

15. A sailboard comprising a hull formed at least partially of a foam material, and a mast box fixedly embedded in said foam material, said hull having an upper surface, and said mast box having an upper surface substantially flush with said upper surface of said hull, means for venting pressure in the sailboard, said venting means being in a portion of said mast box accessible to a user, and a pin for holding a leash rope, said pin extending in said cavity transversely of said side walls and spaced from said bottom wall and said upper surface of said mast box.

16. The sailboard of claim 15 further comprising a mast foot clamped to said mast box, and a leash rope extending through said mast foot, into said cavity, and around said pin in said cavity.

17. The sailboard of claim 15 wherein said sailboard has a face; said mast box has a top portion exposed on a face of said sailboard; and the portion of said mast box including said venting means is said top portion.

18. A method for manufacturing a sailboard comprising fabricating a hull; forming a mast box; forming a vent in said mast box extending from a top of said mast box to an area above a bottom of said mast box; embedding said mast box in said hull with an upper surface of said mast box being substantially flush with an upper surface of said hull; and extending said vent from the area above the bottom of said mast box through the bottom of said mast box; said step of extending said vent through the bottom of said mast box occurring after said step of embedding said mast box in said hull for preventing foam in said hull from escaping through said vent.

19. The method of claim 18 wherein said step of embedding said mast box in said hull occurs during said step of fabricating said hull.

20. A mast box for a sailboard, comprising means for adjustably clamping a mast foot thereto, and means for venting pressure in said sailboard, said venting means being in a portion of said mast box accessible to a user.

21. The mast box of claim 20 wherein said means for venting comprises a hole in said mast box.

22. The mast box of claim 21 further comprising means for selectively sealing said hole.

23. The mast box of claim 20 wherein said means for venting pressure in said sailboard comprises a one way valve in said mast box.

24. The mast box of claim 20 wherein said sailboard has a face; said mast box has a top portion exposed on a face of said sailboard; and the portion of said mast box including said venting means is said top portion.

* * * * *